US010418215B2

(12) United States Patent
Grumel et al.

(10) Patent No.: US 10,418,215 B2
(45) Date of Patent: Sep. 17, 2019

(54) SWITCHGEAR FOR AN ELECTRIC CURRENT WITH SEPARABLE ELECTRICAL CONTACTS AND WITH AIR SWITCHING

(71) Applicant: Schneider Electric Industries SAS, Rueil Malmaison (FR)

(72) Inventors: Christophe Grumel, Lans en Vercors (FR); Sebastien Heraud, Grenoble (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 38 days.

(21) Appl. No.: 15/878,861

(22) Filed: Jan. 24, 2018

(65) Prior Publication Data

US 2018/0240632 A1 Aug. 23, 2018

(30) Foreign Application Priority Data

Feb. 22, 2017 (FR) ..... 17 51389

(51) Int. Cl.
*H01H 71/02* (2006.01)
*H01H 71/12* (2006.01)
*H01H 9/34* (2006.01)

(52) U.S. Cl.
CPC ..... *H01H 71/025* (2013.01); *H01H 71/0257* (2013.01); *H01H 71/12* (2013.01); *H01H 9/346* (2013.01)

(58) Field of Classification Search
CPC .. H01H 71/025; H01H 71/0257; H01H 71/12; H01H 9/346; H01H 2071/147
USPC ..... 200/293, 333
See application file for complete search history.

(56) References Cited

U.S. PATENT DOCUMENTS 6,377,144 B1 4/2002 Castonguay et al.
2012/0026638 A1 2/2012 Ahlert
2017/0110278 A1* 4/2017 Grumel ..... H01H 71/02

FOREIGN PATENT DOCUMENTS

EP 1 098 340 A2 5/2001
WO WO 2010/112420 A1 10/2010

OTHER PUBLICATIONS

French Preliminary Search Report dated Nov. 30, 2017 in French Application 17 51389 filed on Feb. 22, 2017 (with English Translation of Categories of Cited Documents and Written Opinion).

* cited by examiner

*Primary Examiner* — Edwin A. Leon
*Assistant Examiner* — Lheiren Mae A Caroc
(74) *Attorney, Agent, or Firm* — Oblon, McClelland, Maier & Neustadt, L.L.P.

(57) ABSTRACT

A switchgear for an electric current includes a switching assembly that can be switched between an open state and a closed state; a control mechanism including a trigger member for triggering the switching of the switching assembly to the open state; a housing including lateral walls. The lateral walls are elastically deformable when the pressure prevailing inside the housing increases, one of the lateral walls including, on its inner face, a rigid protuberance, the deformation of the wall causing a displacement of the protuberance, the protuberance being arranged relative to the trigger member such that its displacement results in the displacement of the trigger member to its triggering position.

10 Claims, 6 Drawing Sheets

SWITCHGEAR FOR AN ELECTRIC CURRENT WITH SEPARABLE ELECTRICAL CONTACTS AND WITH AIR SWITCHING

The present invention relates to a switchgear for an electric current with separable electrical contacts and with air switching.

Generally, the invention relates to the field of electrical switchgears, such as low-voltage and high-power circuit breakers.

Such switchgears comprise a switching member for an electric current comprising separable electrical contacts. The member can be switched between open or closed positions to interrupt or, respectively, allow the circulation of an electric current within the switchgear. This switching is controlled by means of a control mechanism, for example a toggle mechanism known as "tumbler".

These switchgears also comprise a trigger coupled to the control mechanism which drives this control mechanism, so as to open the switching member when it detects an electrical fault. The electrical fault is generally a short-circuit or an overload of the current circulating in the switchgear. For example, the trigger is of magnetic, or thermal, or electronic type.

Typically, in the case of an electrical fault, the electrical contacts are partially separated from one another by an electromagnetic repulsion force, and are then in an unstable position. An electrical arc then occurs between these electrical contacts. The trigger must therefore order the opening of the switching member as soon as this electrical arc appears, to fully separate the electrical contacts, in order to safely interrupt the circulation of the electric current in the switchgear and ensure a galvanic isolation. This interruption must occur as rapidly as possible after the appearance of the electrical fault, for example in less than 5 ms, in order to avoid damaging the switchgear and avoid a situation contrary to safety. In effect, it is of prime importance to limit the quantity of energy released in the switching.

The known devices do not however give full satisfaction because, in some circumstances, the trigger exhibits a response time to an electrical fault which is not short enough to have the control mechanism react within the necessary delay time. There is therefore a risk of the switching member closing accidentally, thus preventing the interruption of the current.

Switchgears are of course known that aim to remedy this drawback and in which an overpressure within the switchgear, originating from the release of extinguishing gas caused by the electrical arc, is used to trigger the control mechanism before the trigger can enter into action.

An example of such a switchgear is described in the Patent Application FR 2 661 776 A1. This switchgear comprises a piston which is fluidically connected with an electrical arc extinguishing chamber and which is mechanically coupled with the control mechanism. In this way, an abnormal rise in pressure in the switchgear causes a displacement of the piston, which then triggers the opening of the switching member, more rapidly than the trigger associated with this switchgear allows.

Such a solution does however present drawbacks. On the one hand, it requires the addition of an additional device, here a mechanical chain comprising the piston, which complicates the industrial manufacturing of the switchgear and increases the switchgearary cost thereof. Furthermore, the reliability is insufficient, because the fluidic connection between the extinguishing chamber and the piston is likely to be degraded because of the pollution due to the extinguishing gas. Finally, these devices are, despite everything, not sufficiently rapid when they are used in certain operating conditions required by contemporaneous product ranges. In effect, the current requirements lead to a reduction of the dimensions of the switchgears and to an increase in the maximum electric current values involved in the operation of these switchgears. The operation of these devices can no longer therefore be guaranteed. Their use in contemporaneous switchgears is therefore not possible as things stand.

It is these drawbacks that the invention seeks more particularly to remedy, by proposing a switchgear for an electric current with separable electrical contacts and with air switching, this switchgear allowing a rapid opening of the electrical contacts in the case of an electrical fault, while being simple to manufacture and exhibiting a satisfactory reliability.

To this end, the invention relates to a switchgear for an electric current with separable electrical contacts and with air switching, this switchgear comprising:

- a switching assembly that can be switched between an open state allowing the circulation of an electric current within the switchgear and a closed state preventing the circulation of the electric current;
- a mechanism for controlling the switching of the switching assembly between its open and closed states, this control mechanism comprising a trigger member arranged for triggering the switching of the switching assembly to the open state when this trigger member is displaced from a rest position to a triggering position;
- a housing inside which are housed the switching assembly and the control mechanism and comprising lateral walls.

In this switchgear:

- the lateral walls are elastically deformable, from a state of rest to a deformed state, when the pressure prevailing inside the housing increases;
- one of the lateral walls comprises, on its inner face, a rigid protuberance extending towards the interior of the housing at right angles to this inner face, such that the deformation of said lateral wall causes a displacement of the protuberance from a first position to a second position;
- the protuberance is arranged relative to the trigger member such that its displacement to the second position results in the displacement of the trigger member from the rest position to the triggering position.

By virtue of the invention, as soon as an electrical arc appears between the electrical contacts, the increase in pressure resulting from the appearance of the electrical arc causes the deformation of the lateral walls. As the protuberance is rigid and secured with one of the lateral walls, it is displaced under the effect of the deformation of this lateral wall. This displacement, because of the relationship of the protuberance with the trigger member, causes the displacement of the trigger member to a triggering position to displace the separable electrical contacts to the open position. Thus, the triggering is performed rapidly, since the trigger chain of the control mechanism is shorter than in the known devices, by virtue of the absence of an intermediate element such as a piston. The switchgear also exhibits a simplified design, because, inasmuch as the protuberance is formed on the lateral wall, it is easy to incorporate in the manufacturing of the lateral wall. Because of this simplicity of production and the absence of additional device, the manufacturing of the switchgear is simpler and more economical. That also confers a greater robustness on the switchgear, inasmuch as the operation of the protuberance, by virtue of its simplicity, is insensitive to any risk of pollution by the extinguishing gases.

According to aspects of the invention that are advantageous but not mandatory, such a switchgear can incorporate one or more of the following features, taken in isolation or according to any technically admissible combination:

- The protuberance is formed of a single piece with said lateral wall.
- The lateral walls are produced in a moulded thermoplastic material.
- The lateral walls are produced in a glass fibre-reinforced polycarbonate resin.
- The lateral walls exhibit a flexure elasticity modulus which is greater than or equal to 1 GPa, and less than or equal to 5 GPa, such that the amplitude of the deformation of the lateral walls is greater than or equal to 1 mm when the pressure inside the housing becomes greater than or equal to 6 bar.
- The protuberance comprises a rigid beam extending along a longitudinal axis of the protuberance and a stiffener.
- The protuberance has a length greater than or equal to 5 mm.
- A contact zone between the protuberance and the spur is situated at a distance from the inner face which is greater than or equal to a third of the width of the switching assembly.
- The trigger member is rotationally mobile about an axis of rotation and is provided with a protruding spur extending at right angles to the axis of rotation, the spur being placed on the trajectory followed by the protuberance when it is displaced from its first position to its second position.
- The switchgear comprises a trigger block comprising a trigger and a mobile striker, the trigger being configured to displace the trigger member to its triggering position when it detects an electrical fault from the electric current which circulates through the switchgear.

The invention will be better understood and other advantages thereof will become more clearly apparent in light of the following description, of an embodiment of a switchgear given purely by way of example and with reference to the attached drawings, in which:

FIG. 1 schematically represents, according to a longitudinal cross-sectional view, a switchgear for an electric current according to an embodiment of the invention;

FIGS. 1 to 5 represent a switchgear 1 for an electric current, for example a circuit breaker.

In this example, the switchgear 1 is a low-voltage and high-intensity alternating or direct current single-pole circuit breaker. For example, the switchgear 1 is suitable for operating with electrical voltages lower than 1500 V DC or 1000 V AC and with electrical short-circuit currents of an intensity greater than or equal to 1 kA.

As a variant, the switchgear 1 may be different, for example a multiple-pole circuit breaker.

The switchgear 1 is intended to be connected to an electrical circuit in order to ensure the protection thereof against electrical faults. "Electrical fault" here means a short-circuit or an overload of the electric current circulating in the switchgear.

Figure 1:
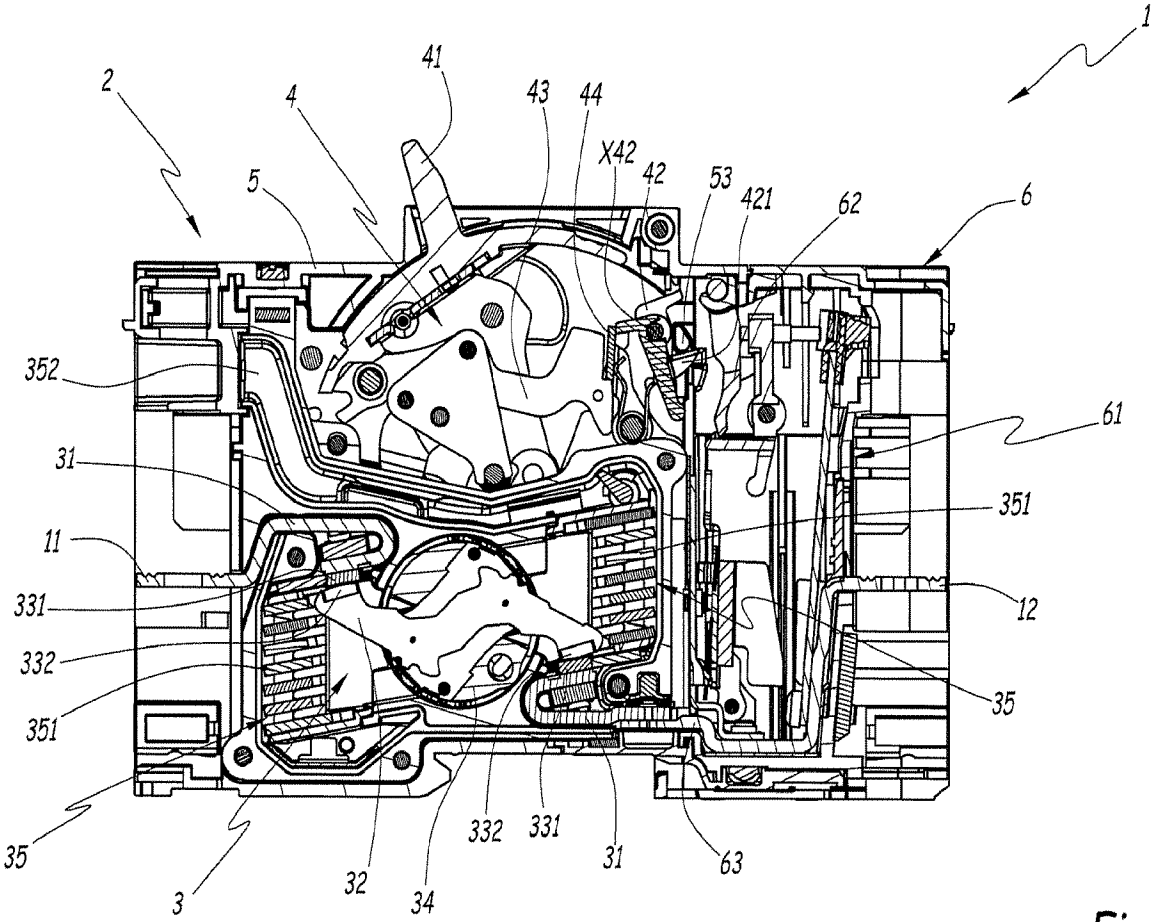

As illustrated in FIG. 1, the switchgear 1 comprises a switching block 2 including a switching member 3, also called switching assembly, a control mechanism 4 and a housing 5. The switchgear 1 also comprises a trigger block 6, described in more detail hereinbelow.

In this example, the switching member 3 and the control mechanism 4 are housed inside the housing 5, in distinct internal compartments of this housing 5.

The member 3 can be switched, reversibly and selectively, between two stable and distinct states, called open state and closed state.

In the closed state, the member 3 allows the circulation of an electric current within the switchgear 1, for example between connecting lands of this switchgear 1.

In the open state, the member 3 prevents the circulation of an electric current in the absence of electrical arc within the switchgear 1.

"Opening" of the member 3 means the switching of the member 3 from the closed state to the open state.

To this end, the member 3 comprises separable electrical contacts produced in an electrically conductive material, such as copper. More specifically, the switchgear 1 here comprises fixed electrical contacts 31 and mobile electrical contacts 32, the latter being able to be displaced in relation to the fixed electrical contacts 31.

The fixed 31 and mobile 32 electrical contacts are here provided with electrically conductive contact pads, respectively denoted 331 and 332.

In the closed state, the fixed and mobile electrical contacts 31 and 32 are in contact with one another. Their respective contact pads 331, 332 are in direct contact, so as to allow the passage of the current between these electrical contacts 31 and 32.

In the open state, the electrical contacts 32 are at a distance from the fixed electrical contacts 31, such that their respective contact pads 331, 332 are electrically insulated by the ambient air.

In this illustrative example, the mobile contacts 32 are formed by a single piece made of an electrically conductive material, which is borne by a rotary member 34 mounted to rotate in relation to the housing 5. Here, there are two fixed contacts 31 and they are arranged symmetrically in relation to the axis of rotation of the member 34.

In FIG. 1, the member 3 is illustrated in the closed state.

As is known, when two electrical contacts 31 and 32 are partially separated while an electric current circulates through the switchgear 1, for example under the effect of a repulsion force resulting from an electrical fault, an electrical arc appears between the corresponding pads 331 and 332. This electrical arc is the result of an ionization of the ambient air. The result thereof is an increase in temperature and then in pressure, because the electrical arc in turn causes the ionization of constituents of the member 3, for example the ionization of the contact pads 331 and 332. The electrical arc is accompanied by an abrupt rise in temperature and in pressure inside the member 3.

The member 3 also comprises electrical arc extinguishing chambers 35, whose function is to ensure the extinguishing of this electrical arc.

The extinguishing chamber 35 comprises a stack of extinguishing plates 351, as well as an extinguishing gas discharge channel 352, which fluidically links the extinguishing chamber to the outside of the housing 5.

Here, there are two chambers 35 and each is placed at the level of a contact zone between a fixed contact 31 and a mobile contact 32.

These extinguishing chambers 35 are well known and are not described in more detail.

As a variant, other configurations of the member 3 are possible, for example by using a single fixed electrical contact and a single mobile electrical contact. The number and the form of the extinguishing chambers 35 are then adapted accordingly.

The control mechanism 4 makes it possible to control the switching of the member 3 between the open and closed states. To this end, the mechanism 4 is here coupled mechanically with the rotary member 34, such that a specific action on the mechanism 4 causes displacement of the electrical contacts 31 and 32 to switch the member 3 between the open and closed states.

The control mechanism 4 comprises a lever 41, also called crank pin, which is accessible from the outside of the housing 5 and which is intended to be manipulated by an operator to switch, through the mechanism 4, the switching member between the open and closed positions. In FIG. 1, the lever 41 is in a position which corresponds to the closed state of the switching member 3.

The control mechanism 4 also comprises a trigger member 42. The member 42 can be displaced between a rest position and a triggering position. When the member 42 switches from the rest position to the triggering position, it triggers the mechanism 4, which then switches the member 3 to the open state. Once the member 3 has switched to the open state, it remains in this open state. The mechanism 4 must be rearmed, for example by means of a manual action by an operator on the lever 41, to once again allow the member 3 to switch to its closed state. The member 42 is then returned to its rest position by the mechanism 4, for example by means of a spring 422.

Here, the mechanism 4 is a toggle mechanism, also called "tumbler". Such a mechanism is well known and, for example, is described in the Patent Application EP 0555158 A1.

In this example, the mechanism 4 comprises the trigger member 42, a hook 43, a lock 44 and a connecting rod 45, the latter ensuring the mechanical coupling between the mechanism 4 and the rotary member 34. The hook 43 is subjected to an elastic return force, which tends to return it to a position corresponding to the open state of the member 3. This return movement is inhibited by the hooking of an end of the hook 43 onto the lock 44, as long as the latter is itself held hooked onto the trigger member 42 as long as it is in its rest position.

When the trigger member 42 is displaced to its triggering position, it allows a displacement of the hook 43, which in turn allows a displacement of the connecting rod 45 to the open state of the member 3.

The trigger member 42 is here mounted to rotate, between its rest and triggering positions, about an axis of rotation X42 at right angles to the lateral walls of the housing 5.

Furthermore, the trigger member 42 is here provided with a protruding spur 421, extending at right angles to the axis of rotation X42, whose function is described in more detail hereinbelow.

The trigger block 6 is configured to trigger the switching of the member 3 to the open state, via the mechanism 4, when an electrical fault is detected from the current which circulates through the switchgear 1.

As illustrated in FIG. 1, the trigger block 6 comprises to this end a trigger 61, here of magneto-thermal type, which is suitable for monitoring the electric current which circulates in the trigger block and to set a mobile striker 62 of the block 6 in motion when it detects the appearance of an electrical fault. Such a trigger is well known to the person skilled in the art and is not described here in more detail. The block 6 is also provided with a connector 63 intended to be linked to the switching block 2.

In practice, in an operating configuration of the switchgear 1, the trigger block 6 is attached to the switching block 2 and the connector 63 is linked electrically to a corresponding fixed electrical contact 31 of the member 3. Thus, the trigger block 6 can react according to the current circulating through the electrical switchgear 1.

"11" and "12" denote connecting lands of the switchgear 1. These lands 11 and 12 make it possible to connect the switchgear 1 to the electrical circuit that it has to protect. The land 11 here corresponds to an end of one of the fixed electrical contacts 31, whereas the land 12 corresponds to an outer end of the connector 63.

Figure 2:
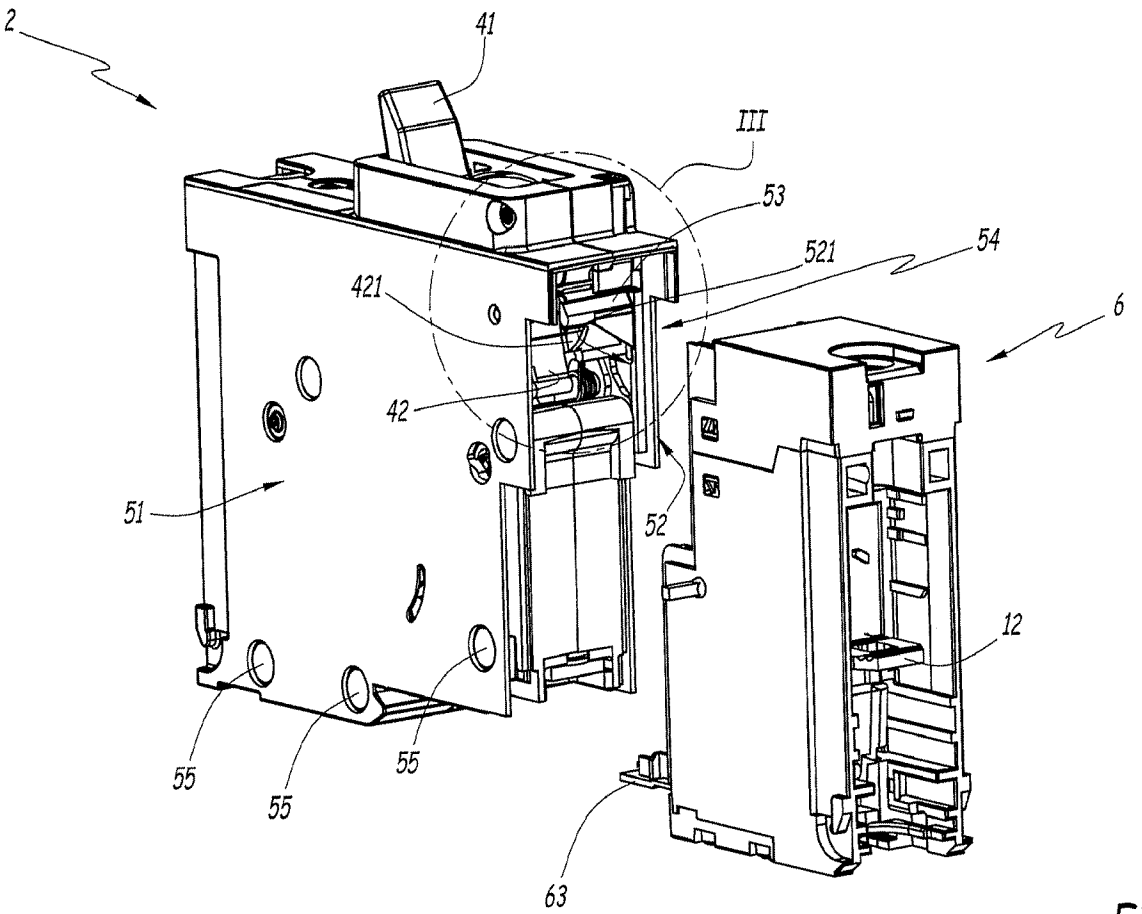
FIG. 2 is a schematic representation, according to a perspective and partially exploded view, of the switchgear of FIG. 1.

To facilitate the reading of FIG. 2, the trigger block 6 is illustrated detached from the switching block 2.

When an electrical fault is detected by the trigger 61, the latter causes displacement of the striker 62, which then comes to exert a mechanical force on the trigger member 42, so as to displace it to its triggering position. In response, the control mechanism is triggered and causes the switching and then the holding of the switching member 3 in the open state, so as to interrupt the circulation of the electric current between the lands 11 and 12.

The housing 5 forms an outer jacket of the switching block 2.

In this example, the trigger block 6 can be detached from the switching block 2. The housing 5 forms a jacket of only the switching block 2. Thus, the housing 5 surrounds at least the member 3 and the mechanism 4. The trigger block 6 comprises its own housing.

The housing 5 comprises in particular lateral walls 51, 52 which delimit opposing lateral faces of the switching block 2.

In this example, the lever 41 is situated on a front face of the switchgear 1. The lateral faces extend at right angles to this front face and at right angles to bottom and top faces of the switching block 2. The trigger block 6 is here attached to the switching block 2 on a bottom face of this switching block 2.

The lateral walls 51 and 52 are deformable, reversibly, between a normal state and a deformed state.

In the normal state, the lateral walls 51 and 52 have an essentially planar form and extend parallel to one another.

Figure 4:
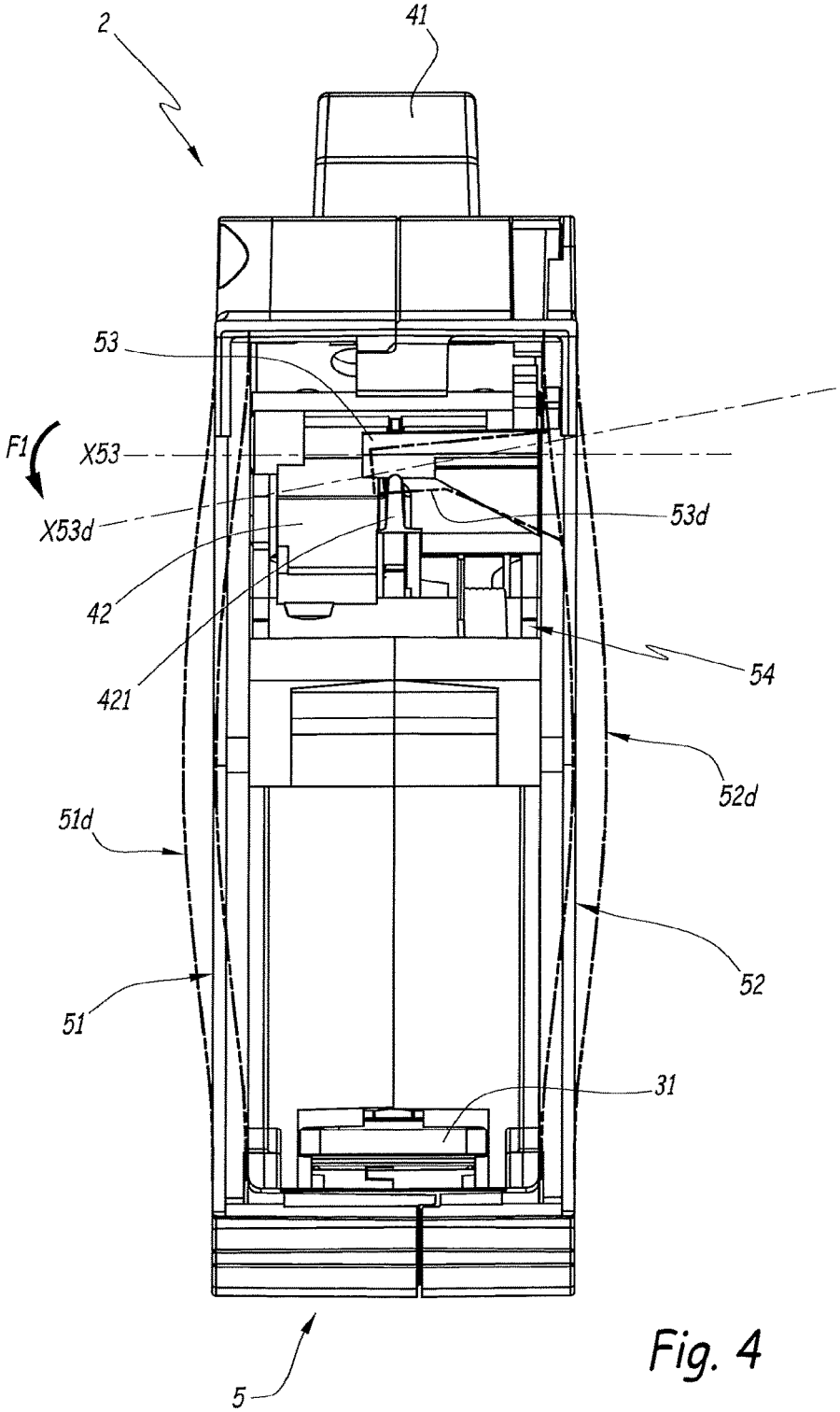
FIG. 4 is a schematic representation, according to a bottom side view, of the switchgear of FIGS. 1 to 3.

In the deformed state, the lateral walls 51 and 52 exhibit a form domed outwards from the switchgear 1, as illustrated in FIG. 4. The amplitude of the deformation of each wall 51, 52 is, for example, measured as being the distance between the positions of the centre of this wall between the normal and deformed states.

In practice, in this example, the walls 51 and 52 are simultaneously either in their normal state, or in their deformed state, since they surround the same member 3. However, when they are in a deformed state, they may not exhibit a strictly identical deformation, that is to say of the same form or of the same amplitude, notably because of the arrangement of the constituents of the switchgear 1 inside the housing 5.

In FIG. 4, the dotted lines bearing the references 51*d* and 52*d* illustrate the position of the lateral walls, respectively 51 and 52, when they are in the deformed state.

The walls 51 and 52 are deformed, elastically, from their normal state to their deformed state, when the pressure inside the housing 5 increases.

For example, a deformation greater than or equal to 1 mm is observed when the pressure exceeds a value of 6 bar, this deformation being measured here on an axis parallel to the axis X42.

When the pressure decreases, the walls 51, 52 revert to their normal state.

Such an increase in pressure is caused by the appearance of the electrical arc upon the separation between the fixed contacts 31 and the mobile contacts 32 of the member 3. In effect, typically, the increase in pressure is such that the extinguishing gases generated by the electrical arc cannot be instantaneously discharged in the output channel 352. They then expand inside the housing 5 and generate an overpressure, relative to the pressure prevailing normally in this housing 5. For example, the pressure increases to be greater than or equal to 6 bar, even greater than or equal to 20 bar.

To avoid any irreversible damage to the switchgear 1, the electrical arc must be interrupted as quickly as possible to limit this overpressure. For example, it is desirable to open the member 3 before the pressure in the housing becomes greater than or equal to 5 bar.

Preferably, the housing 5 is produced from a thermoplastic material, for example by moulding.

The walls 51 and 52 are produced in the same material as the housing 5.

As an illustrative example, the walls 51 and 52 exhibit an elasticity modulus of between 1 GPa and 5 GPa.

Advantageously, the walls 51 and 52 are shock-resistant and in particular exhibit an impact resistance greater than or equal to 10 kJ/m$^2$. This impact resistance is here measured with the so-called Charpy test method as defined by the ISO 179/1eA standard, performed at ambient temperature and with a probe of dimensions 80×10×3 mm.

Preferably, the housing 5, and therefore the walls 51 and 52, are produced in glass fibre-reinforced polycarbonate.

For example, the polycarbonate resin marketed under the reference LEXAN® EXL5689 by the company SABIC is used. As a variant, it is possible to use instead the polycarbonate resin marketed under the reference XANTAR® XRM5010 by the company MITSUBISHI ENGINEERING PLASTICS CORPORATION.

In this example, the walls 51, 52 each have a thickness greater than or equal to 1 mm and less than or equal to 3 mm, this thickness being measured when the walls 51, 52 are in the state of rest.

The choice of such a material with these mechanical properties makes it possible to guarantee a good mechanical strength of the housing 5, while obtaining a deformation of the walls 51, 52 as a function of the pressure in the housing 5.

Since the deformation is elastic, the walls 51, 52 revert to their state of rest when the pressure in the housing 5 is once again equal to the surrounding atmospheric pressure, without the housing 5 suffering mechanical after-effects prejudicial to its operation.

As an illustrative example, the housing 5 is here formed by two moulded half-shells, similar to one another and of forms complementing one another, each bearing a wall 51, 52. These two half-shells are intended to be secured to one another in order to guarantee the integrity of the housing 5. To this end, the housing 5 comprises means for fixing the walls 51, 52.

In this example, the fixing means are rivets, whose respective heads bear the reference 55. The walls 51, 52 then comprise through-holes to allow the passage of these rivets. Preferably, the fixing means are arranged only close to the edges of the walls 51, 52, so as not to hamper the deformation thereof.

The housing 5 also comprises a window 54 which at least partly exposes the trigger member 42 outside the housing 5. In this way, the striker 62 can act mechanically on the member 42, even when the striker 62 is situated outside the housing 5.

According to a variant, the trigger 61 and the striker 62 can be housed inside the housing 5. In this case, the window 54 can be omitted.

Figure 3:
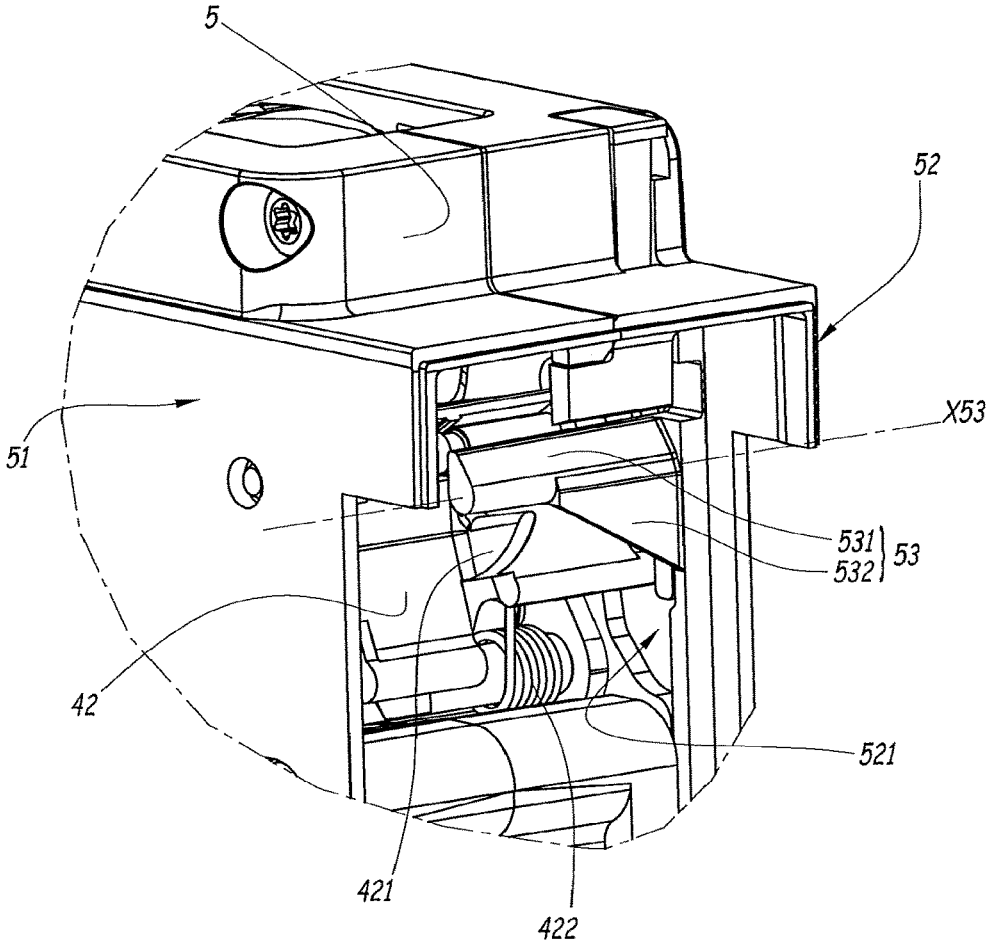
FIG. 3 is a schematic representation, according to a close-up view of the zone III of FIG. 2, of a portion of the switchgear of FIG. 2.

As illustrated in more detail in FIGS. 3 and 4, one of the lateral walls, in this particular case the lateral wall 52, also comprises, on its inner face 521, a rigid protuberance 53 which extends towards the interior of the housing 5, at right angles to this inner face 521. The protuberance 53 is secured to the wall 52, preferably with no flexure degree of freedom.

The inner face 521 is here the face of the lateral wall 52 which is turned towards the interior of the housing 5. This inner face 521 is opposite the outer face of the lateral wall 52.

Because it is secured to the deformable lateral wall 52, the protuberance 53 can be displaced between a first position and a second position. The protuberance 53 is in the first position when the lateral wall 52 is in the normal state, and in the second position when the lateral wall 52 is in the deformed state.

In this way, the protuberance 53 is displaced to its second position as the corresponding lateral wall 52 is deformed from its normal state to its deformed state.

Preferentially, the protuberance 53 is formed of a single piece with the corresponding lateral wall 52. In other words, the protuberance 53 is made of the same material as the wall 52. That makes it possible to further simplify the manufacturing of the switchgear 1, since the protuberance 53 is then manufactured simultaneously with the lateral wall 52, for example in one and the same moulding operation.

As a variant, however, the protuberance 53 can be an added piece distinct from the wall 52 and which is fixed securely to the wall 52. For example, this fixing is done by means of a rivet or by gluing or by welding.

X53 denotes the longitudinal axis along which the protuberance 53 extends when it is in its first position and X53*d* denotes the direction in which the protuberance extends when it is in the second position. The axis X53 is here at right angles to the walls 51 and 52 when they are in their state of rest.

As an example, the angle between the axes X53 and X53*d* is greater than or equal to 8° when the wall 52 is deformed by an amplitude greater than or equal to 1 mm.

The protuberance 53 is arranged relative to the trigger member 42 such that its displacement from its first position to its second position results in a displacement of the trigger member 42 from its inactive position to its triggering position. In this way, the displacement of the protuberance 53 resulting from the deformation of the walls 51, 52 causes the triggering of the mechanism 4 to switch the switching member 3 to its open state.

In other words, the protuberance 53 is, here, coupled with the trigger member 42.

To this end, the spur 421 is here placed on the trajectory followed by the protuberance 53 between its first and second positions. The protuberance 53 is here arranged above the spur 421.

For example, when the protuberance 53 is in its first position and the member 42 is in its rest position, then the bottom face of the beam 531 is in contact with the spur 421 but without exerting force on this spur 421. When it switches into its second position, the protuberance 53 bears on the spur 421, since it is situated on its trajectory, and drives the latter in rotation about the axis X42.

The dimensions of the protuberance 53, in particular its length and its position, are also chosen as a function of the force that has to be applied to the spur 421 in order to displace the member 42 to its triggering position.

As an illustrative example, the protuberance 53 is suitable for exerting a force on the spur 421 of intensity greater than or equal to 5 Newtons when it is displaced to its second position.

The spur 421 advantageously acts as a lever and makes it possible to reduce the force needed to rotate the member 42.

Furthermore, the length of the protuberance 53, the length of the spur 421 and the relative position of the spur 421 in relation to the protuberance 53 are suitable for benefiting from a lever effect, which reduces the force needed to displace the trigger member 42 to its triggering position.

For example, the contact zone between the protuberance 53 and the spur 421 is situated at a distance from the inner face 521 which is greater than or equal to a third of the width of the member 3, more preferably equal to half this width. The contact zone is here the portion of surface of the spur 421 on which the protuberance 53 bears when it is displaced to its second position while the member 42 is in its rest position.

This width is, for example, measured along the axis X53. Here, this width is equal to the separating distance between the lateral walls 51 and 52.

The length of the protuberance 53 is preferably greater than or equal to 10 mm. The length of the protuberance 53 is here measured along the axis X53 when it is in its first position.

In this example, complementarily, the spur 421 is dimensioned such that the distance between said contact zone and the axis X42 is equal, for example to within 5%, to the distance between the axis X42 and the zone of attachment of the member 42 to the lock 44.

Advantageously, the protuberance 53 comprises a beam 531 and a stiffener 532. The beam 531 and the stiffener 532 are here produced in the same material.

The beam 531 extends longitudinally along the axis X53 and has a cylinder form with a cross-sectional area greater than or equal to 5 $mm^2$.

The stiffener 532 here comprises a planar wall of triangular form which extends under this beam 531 and which is anchored to the inner face 521 along one of its sides and anchored to the beam 531 along another of its sides.

The choice of the dimensions of the protuberance 53, in particular its form and/or its cross section, as well as the use of the stiffener 532, make it possible to increase the stiffness of the protuberance 53. That is particularly useful when the protuberance 53 is formed of a single piece with the lateral wall 52. In effect, the protuberance is then produced in the same material as the lateral wall 52. Now, this material is deformable, although there is a specific desire to avoid having the protuberance 53 itself being deformed when it bears on the member 42.

The protuberance 53 thus makes it possible to trigger the control mechanism 4 upon the appearance of an electrical arc between electrical contacts 31, 32, which generates a release of extinguishing gas and therefore an overpressure in the housing 5.

When the lateral walls 51, 52, and in particular the lateral wall 52, are deformed because of an increase in pressure in the housing 5, they switch to their deformed state. Because of this deformation, the protuberance 53 is displaced to its second position. The direction of displacement of the protuberance 53 is illustrated by the arrow F1 in FIG. 4 and by the arrow F2 in FIG. 5.

Figure 5:
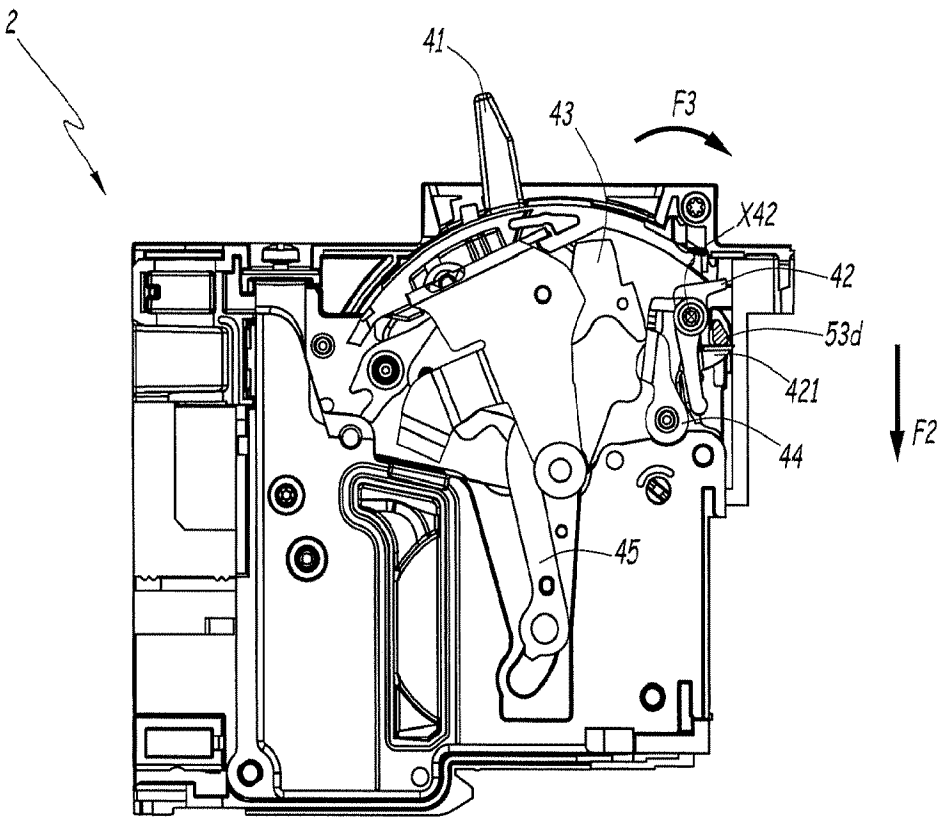
FIG. 5 is a schematic representation, according to a lateral view, of a control mechanism of the switchgear of FIGS. 1 to 4.

The protuberance 53 then exerts a force on the spur 421, which causes the displacement of the trigger member 42 to its triggering position, as illustrated by the arrow F3 in FIG. 5. Because of the design of the mechanism 4, this displacement of the member 42 in turn causes the switching of the member 3 to its open state, as explained previously. The electrical contacts 31 and 32 are then kept separated, thus guaranteeing the stopping of the circulation of the electric current.

By virtue of the invention, as soon as an electrical arc appears between the electrical contacts, the increase in pressure which results from the appearance of the electrical arc causes the deformation of the lateral walls 51, 52 and therefore the triggering of the mechanism 4, via the protuberance 53.

Thus, the triggering of the mechanism 4 is performed rapidly, since the trigger chain is shorter than in the known devices, by virtue of the absence of an intermediate element such as a piston.

As an illustrative example, for a breaking current of an intensity greater than or equal to 8 kA peak, the overpressure generates the triggering of the mechanism 4 after a time less than or equal to 1 ms. In the same circumstances, the trigger 61 comes into action, by displacing the striker 62, only after a time of 3 ms.

Furthermore, by virtue of this production simplicity and of the absence of additional device, such as a piston, the manufacturing of the switchgear 1 is simpler and more economical. That also confers a better robustness on the switchgear 1, inasmuch as the operation of the protuberance 53, by virtue of its simplicity, is insensitive to any risk of pollution by the extinguishing gases.

The fact that the protuberance 53 is configured to act on the trigger member 42 makes it possible to trigger the mechanism 4 by using the same control chain as the trigger 61. It is therefore not necessary to modify the architecture of the existing control mechanisms, or to increase the outer volume and the bulk of the switching block 2.

The invention thus makes it possible to use the deformation of the lateral walls 51 and 52 caused by the overpressure due to the extinguishing gases, which is traditionally perceived as a detrimental and undesirable effect, in order to control the triggering of the mechanism 4 rapidly and reliably and with simplified implementation.

Figure 6:
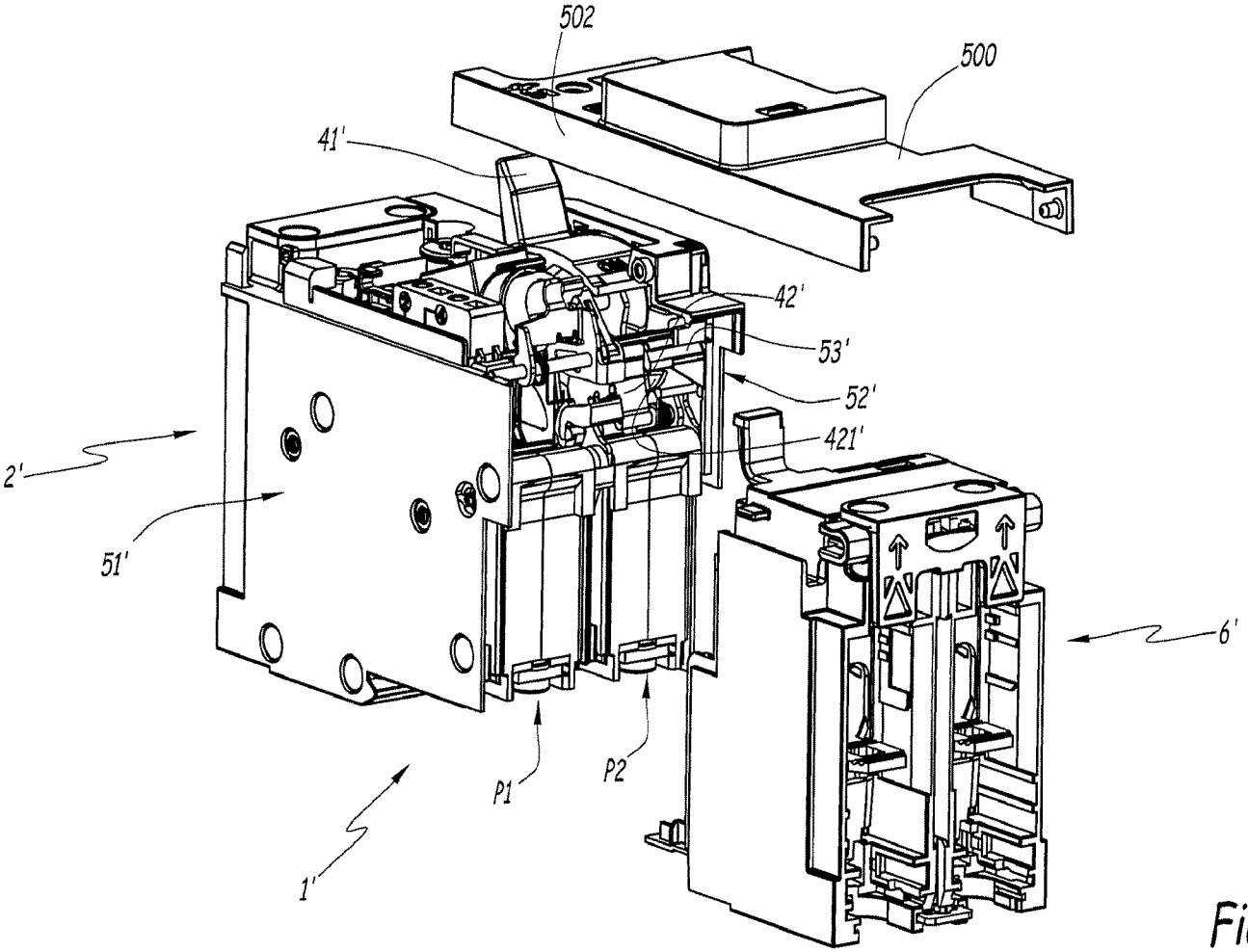
FIG. 6 is a schematic representation, according to a perspective and partially exploded view, of a switchgear for an electric current according to another embodiment of the invention.

FIG. 6 represents an electrical switchgear 1' according to a second embodiment of the invention. The elements of the switchgear 1' of this embodiment which are similar to the switchgear 1 bear the same references plus the symbol and are not described in more detail, inasmuch as the description above can be transposed to them.

More specifically, the switchgear 1' is a two-pole electrical circuit breaker, suitable for operating with electric currents circulating on two distinct electrical poles P1 and P2.

The switchgear 1' here comprises a switching block 2' and a trigger block 6', which serve the same purpose, respectively, as the blocks 2 and 6 of the switchgear 1.

The block 2' differs in particular from the block 2 in that it comprises two switching members, or switching assemblies, each associated with one of the electrical poles P1 and P2. The switchgear 1' then comprises several connecting lands associated with each of the poles P1 and P2.

The block 2' also comprises a control mechanism similar to the mechanism 4, provided in particular with a lever 41' and a trigger member 42' including a spur 421'. The control mechanism of the block 2' is arranged to simultaneously control the two switching members of the block 2' in one and the same state, notably to simultaneously open the two switching members of the poles P1 and P2.

The switchgear 1' comprises a housing similar to the housing 5 and inside which is housed the block 2'. This housing comprises deformable lateral walls 51' and 52' similar to the walls 51,52.

The wall 52' bears a protuberance 53' which serves the same purposes the protuberance 53. In particular, the protuberance 53' is suitable for being displaced to its second position when the wall 52' is deformed, under the effect of an increase in the pressure in the housing, resulting from the appearance of an electrical arc in at least one of the switching members of the block 2'. By being displaced, the protuberance 53' exerts a force on the spur 421', which displaces the member 42' to its triggering position in order to open the switching members of the block 2'.

Because the protuberance 53' is borne by only the lateral wall 52', the invention is easily applicable to units other than the switchgear 1, without the need to modify their architecture depthwise.

As an illustration, because of the structure of the block 2', the distance previously defined between the contact zone and the wall 52' is here equal to the separating distance between the wall 52' and the geometrical plane separating the two switching members of the block 2' from one another.

In this example, the switchgear 1' also comprises a cover 500 intended to cover a front face of the switchgear 1'. This cover 500 is provided with folded-down lateral flanges 502 which are intended to cover the front edge of the lateral faces 51', 52' when the cover 500 is in mounted configuration on the switchgear 1'. Preferably, the dimensions of the flanges 502 are limited so as not to hamper the deformation of the walls 51' and 52'.

The embodiments and the variants envisaged above can be combined with one another to generate novel embodiments.

The invention claimed is:

1. A switchgear for an electric current with separable electrical contacts and with air switching, the switchgear comprising:

a switching assembly that can be switched between an open state allowing the circulation of an electric current within the switchgear and a closed state preventing the circulation of the electric current;

a mechanism for controlling the switching of the switching assembly between its open and closed states, this control mechanism comprising a trigger member arranged for triggering the switching of the switching assembly to the open state when this trigger member is displaced from a rest position to a triggering position; and a housing inside which are housed the switching assembly and the control mechanism and comprising lateral walls, wherein the lateral walls are elastically deformable, from a state of rest to a deformed state, when the pressure prevailing inside the housing increases, one of the lateral walls comprises, on its inner face, a rigid protuberance extending towards the interior of the housing at right angles to this inner face, such that the deformation of said lateral wall causes a displacement of the protuberance from a first position to a second position, and the protuberance is arranged relative to the trigger member such that its displacement to the second position results in the displacement of the trigger member from the rest position to the triggering position.

2. The switchgear according to claim 1, wherein the protuberance is formed of a single piece with said lateral wall.

3. The switchgear according to claim 1, wherein the lateral walls are produced in a moulded thermoplastic material.

4. The switchgear according to claim 3, wherein the lateral walls are produced in glass fibre-reinforced polycarbonate resin.

5. The switchgear according to claim 1, wherein the lateral walls exhibit a flexure elasticity modulus which is greater than or equal to 1 GPa, and less than or equal to 5 GPa, such that the amplitude of the deformation of the lateral walls is greater than or equal to 1 mm when the pressure inside the housing becomes greater than or equal to 6 bar.

6. The switchgear according to claim 1, wherein the protuberance comprises a rigid beam extending along a longitudinal axis of the protuberance and a stiffener.

7. The switchgear according to claim 1, wherein the protuberance has a length greater than or equal to 5 mm.

8. The switchgear according to claim 1, wherein the trigger member is rotationally mobile about an axis of rotation and is provided with a protruding spur extending at right angles to the axis of rotation, the spur being placed on a trajectory followed by the protuberance when it is displaced from its first position to its second position.

9. The switchgear according to claim 8, wherein a contact zone between the protuberance and the spur is situated at a distance from the inner face which is greater than or equal to a third of a width of the switching assembly.

10. The switchgear according to claim 1, wherein a trigger block comprises a trigger and a mobile striker, the trigger being configured to displace the trigger member to its triggering position when it detects an electrical fault from the electric current which circulates through the switchgear.

* * * * *